US005294065A

United States Patent [19]

Harms et al.

[11] Patent Number: 5,294,065

[45] Date of Patent: Mar. 15, 1994

[54] PORTABLE SCREENING/DOSING/MIXING PLANT

[75] Inventors: Timothy O. Harms, St. Helena, Nebr.; Daryl P. Jones, Yankton, S. Dak.; Richard D. Maska, Yankton, S. Dak.; Mark D. Mulloy, Yankton, S. Dak.

[73] Assignee: Portec, Inc., Oak Brook, Ill.

[21] Appl. No.: 11,324

[22] Filed: Jan. 29, 1993

[51] Int. Cl.[5] ..... B02C 9/04

[52] U.S. Cl. ..... 241/101.7; 241/76; 241/101.8

[58] Field of Search ..... 241/76, 81, 101.2, 101.6, 241/101.7, 101.8

[56] References Cited

U.S. PATENT DOCUMENTS

| | | | |
|---|---|---|---|
| 2,649,630 | 8/1953 | Thomley | 241/101.7 X |
| 3,226,043 | 12/1965 | Bowman | 241/101.7 X |
| 3,409,235 | 11/1968 | Quinn | 241/101.7 X |
| 4,598,875 | 7/1986 | Bromson et al. | 241/101.7 X |

OTHER PUBLICATIONS

Portec-Kolberg Bulletin 50, "Kolberg Series 50 Pugmill Plants", 6 pp, printed Jul. 1990.

Portec-Kolberg Bulletin 271, "Kolberg Model 271 shredder screening plant", 2 pp. May, 1991.

Portec-Kolberg Bulletin 26, "Kolberg Series 26 Heavy Duty Diesel-Hydraulic Screening Plants", 4 pp, Oct. 30, 1989.

Portec-Kolberg, "Kolberg Look Book", 5th edition, 1989, pp. 26-27; and Portec-Kolberg Bulletin 1400-A, Kolberg Series 1400 Surge Bin/Belt Scale Truck Load-Out System, 4 pp., Aug. 1985.

*Primary Examiner*—Douglas D. Watts

*Attorney, Agent, or Firm*—Moore & Hansen

[57] ABSTRACT

A high-rate portable self-contained combination screening/dosing/mixing plant is mounted on a single tractor trailer for highway travel in most states without requiring travel escort vehicles. The plant has a nominal capacity of about 100 tons of soil or dirt per hour, and includes an apparatus train for preliminary separation of large objects, hopper storage, uniform feed rate, shredding-pulverization, particle size screening, additive dosing, mixing and conveyance to an elevated position for transfer to a dump truck, bin or pile.

18 Claims, 6 Drawing Sheets

PORTABLE SCREENING/DOSING/MIXING PLANT

BACKGROUND OF THE INVENTION

This invention relates generally to machines for screening a particulate, granular or other multi-sized material and treating a size fraction thereof. More particularly, this invention pertains to portable apparatus useful for soil remediation and the like.

At numerous locations, the ground has been contaminated by accidental or deliberate application of gasoline, fuel oil, used petroleum products, or various chemicals. In most soil remediation processes, the contaminated soil is first removed from the ground and separately treated to chemically or biochemically remove the contaminant or transform it into a non-soluble, non-volatile and/or non-offensive material. In most of these processes, a remediating additive is to be introduced and mixed with the contaminated soil.

In one type of process, specialized microorganisms which consume the contaminant may be introduced or dosed in either solid or a liquid form.

In other remediating processes, various chemical entities may be added which bind with or encapsulate the contaminant. Certain contaminants may be chemically converted to non-toxic or less toxic substances.

In most cases, the soil must be pulverized into small particles so that material surfaces are effectively exposed to the additive. In addition, the contaminated soil and additive must be intimately mixed to ensure rapid remediation.

The extent of many contaminated sites requires large quantities of soil to be removed and treated. For example, a 5 acre site contaminated to a depth of 6 feet requires the removal of about 50,000 cubic yards of material weighing about 40,000 to 100,000 tons, depending upon the type of soil and moisture content. Economic treatment typically dictates high treatment rates of 50 or more tons per hour. Thus, a treatment plant operated at 80 tons per hour will take about 5 months (at 168 hours/month up-time) to complete the remediation operation.

Many contamination sites are much smaller, of course, requiring much less treatment time. Likewise, some contamination sites are of considerably greater extent.

In the past, equipment for performing such large-scale remediation was mounted on a plurality of trailers or trucks, each separately transported to the remediation site. Multiple trailers requiring intermediate process equipment results in higher equipment costs. Significant costs associated with such operations include the use of multiple truck drivers. In addition, if oversize trailers are used, escort vehicles may be required, increasing the overall cost of travel between operation sites.

The plurality of trailer mounted units also requires considerable on-site assembly time for connecting the trailers with conveyors to form a single operating train. Additional conveyors may be required for transporting the process material from trailer to trailer, and the plant may require more ground area than is desirable, i.e. have an excessive "footprint".

One of the factors which must be addressed in designing a treatment train is the change in elevation of the material being treated as it passes through a treatment step. When the elevation drop is great enough so that the material cannot be discharged from one treatment step directly into the following step, a conveyor must be used to gain the desired elevation. Because of the sizeable elevation drop of the "fines" through a screening operation, portable apparatus for screening have required an intermediate hopper and conveyor for collecting screened material and feeding it to a mixer.

A related constraint affects the sizes of the belt conveyors. The angle at which solids may be conveyed upwardly by belt conveyor has a relatively low maximum value. If this value is exceeded, the materials being conveyed may slip backwards and/or fall off the sides of the conveyor belt. At a given angle, the minimum length of a conveyor is proportional to the vertical difference between the inlet and outlet elevations.

BRIEF SUMMARY OF THE INVENTION

The primary objective of this invention is to produce a unitary portable machine which includes apparatus for pulverizing and screening a particulate material, intimately mixing an additive therewith and discharging the treated material.

Another objective of the invention is to produce a high-capacity self-contained soil remediation machine which is easily transported to a contamination site.

An additional objective is to produce a high capacity soil remediation machine which requires no external power source.

A further objective of the invention is a high-rate machine including apparatus for pulverizing and screening a particulate base material, introducing an additive, and intimately mixing the additive with the base material, wherein all of the apparatus is mounted on a single over-the-road trailer of a size and weight for travel without escort vehicles.

An additional objective of the invention is to produce such a machine for the purpose of soil remediation, wherein a design soil handling rate of about 75 to 100+ tons per hour is adaptably variable to accommodate widely ranging remediation site sizes and conditions. The cost of multiple truck drivers and escorting vehicles is eliminated or reduced.

More particularly, the objective encompasses a portable plant for the remediation of ground material by chemical conversion, chemical fixation, encapsulation, pH adjustment, solidification, devolatilization, microbial addition and/or other treatment with an additive material.

To meet a further objective, a unitary portable large-scale plant is produced which first breaks up and screens a stream of compost substrate or composted organic matter. In the plant, an additive such as wastewater filtercake or lime is then added, and the combination is intimately mixed and continuously discharged to a vehicle, storage container or pile. Oversized materials are rejected from the process stream and separately removed for reprocessing or separate disposal.

The invention is a self-contained portable unitary plant for size-screening a particulate material, combining and intimately mixing an additive with the screened material, and discharging the mixture.

These and other objects and advantages of the invention will be readily understood by reading the following description in conjunction with the accompanying figures of the drawings wherein like reference numerals have been applied to designate like elements throughout the several views.

BRIEF DESCRIPTION OF THE DRAWINGS

FIGS. 1A and 1B together form a right side elevation view of a portable screening/dosing/mixing plant in accordance with an embodiment of the invention;

DESCRIPTION OF THE PREFERRED EMBODIMENTS

Figure 1A:
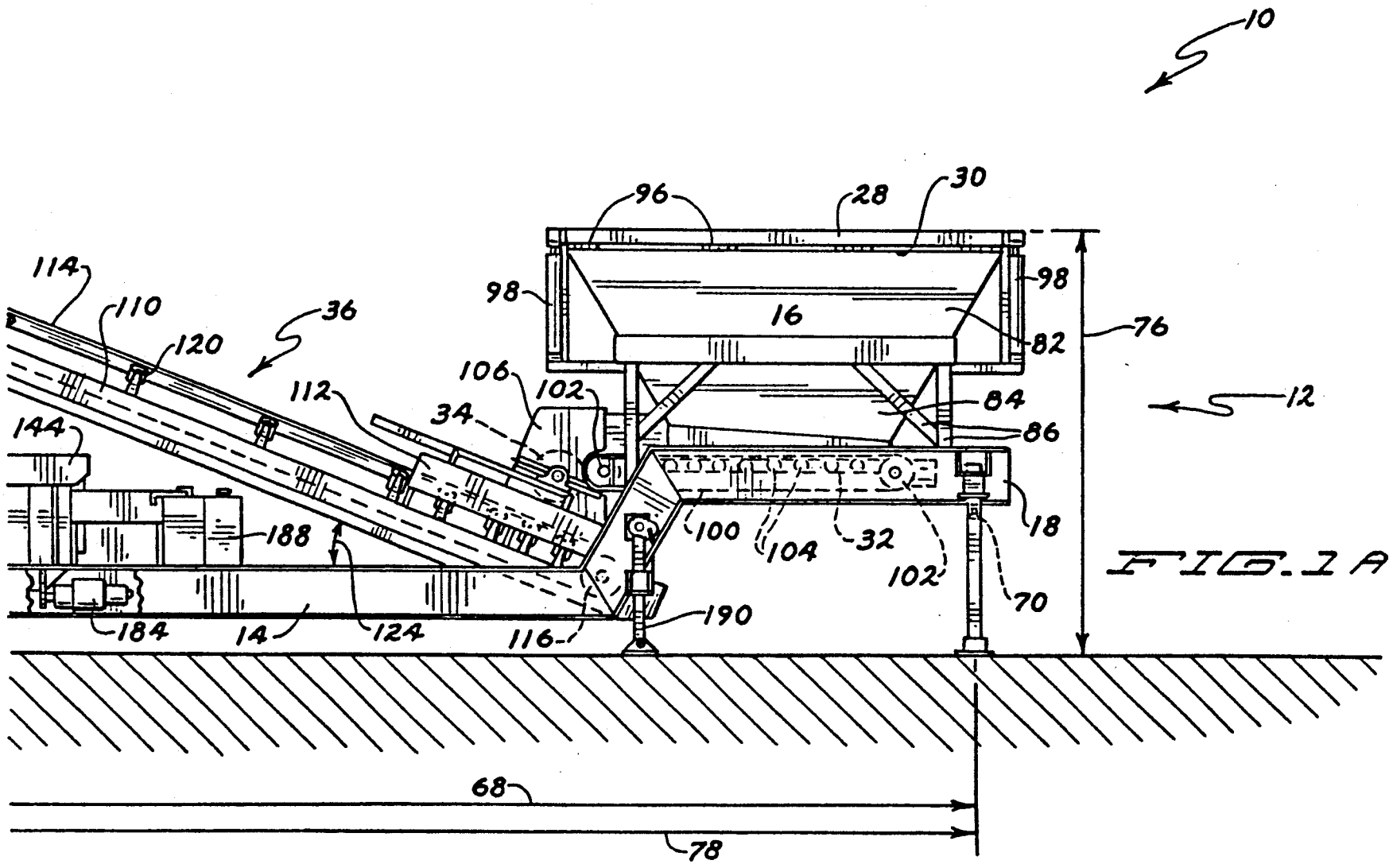

With reference to the drawings, and particularly to FIG 1A and 1B, a portable, trailer-mounted, self-contained combination screening/dosing/mixing plant is depicted which is effective for intimately combining two streams of materials. The plant is useful for e.g., remediation of contaminated soil, production of soil amendment materials, and high rate blending of desired additives with solid particulate materials.

While the apparatus is known herein as a "screening-/dosing/mixing" plant, it is to be understood that the material being processed undergoes other operation steps including grizzly size separation, pulverization, oversize material transport, product transport and discharge.

As used herein, the term "particulate" refers to any material which is primarily noncontinuous and largely comprises solid or semi-solid pieces. The particulate material referred to may range from uniformly sized grains, such as sand, to a soil or compost having entities of widely varying sizes and compositions, including materials of animal, vegetable and/or mineral origin. Moisture or other liquid may be associated with the solids. Thus, a contaminated soil may contain mineral soils as well as grass and other plant growth. In addition, the soil may include matter of animal origin.

As shown in FIG. 1, the screening/mixing plant 10 comprises a process train 12 for continuously processing a material at a high rate. The entire process train 12 is mounted on a single trailer 14 capable of road transport without accompaniment by escort vehicles.

The train 12 is configured to receive the soil or other particulate material in a primary hopper 16 and transport it in a stream from the front end 18 of the trailer 14 to the rear end 20 thereof, and discharging the material rearwardly of the trailer 14 at an elevated position 22 which is preferably at a height 24 at least 12 feet above ground level 26.

Following the general order in which materials are processed, FIGS. 1-4 show the equipment mounted on the trailer 14 in an operating mode. The items of equipment include the primary hopper 16 with a grizzly 28 mounted on the hopper inlet 30 for rejecting grossly oversize objects in the material stream. A belt feeder 32 is mounted below the hopper 16 to transfer a stream of material to a shredder 34 such as a hammer mill. Shredded material is discharged from the shredder 34 to a primary belt conveyor 36 which transports the material upward and rearward to a discharge hood 38. The hood 38 directs the stream of shredded material to a reverse-mounted single deck vibrating screen 40 which separates oversize material from the stream and also acts to further reduce the size of some types of material. Oversize materials are carried away from the plant 10 by an oversize cross conveyor 42. Materials of small particle size pass through the screen 40 into a discharge chute 44 which supplies the inlet end 46 of a mixer 48 comprising a pug mill. A foldable belt conveyor 50 herein known as an end conveyor is positioned to receive mixed material from the pug mill 48 and convey it to the elevated discharge position 22.

Figure 5:
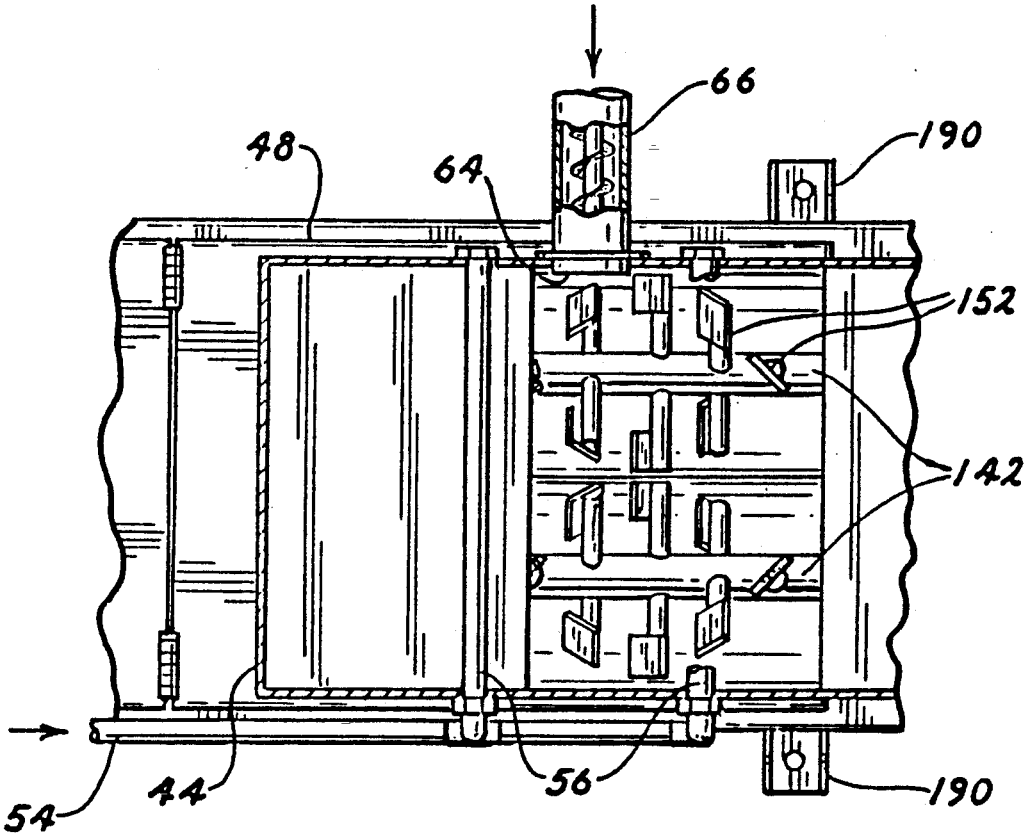
FIG. 5 is a cross-sectional plan view through the vibrating screen discharge chute of a portable screening/dosing/mixing plant of the invention.

The train 12 also includes means for introducing an additive to the material prior to mixing in the pug mill 48. The figures show additive introducing means in alternative forms. A pump 52 is shown mounted on the trailer 14 for introducing a liquid additive through conduit 54 to one or more spray bars 56 placed within the screen discharge chute 44 above the mixer 48 (see FIG. 5). Pump 52 has an inlet 60 configured for connection to a conduit from a tanker truck, not shown, or a separate stationary tank. The pump 52 may be a metering pump for controlling the liquid flow rate, or the flow may be controlled by a separate valve 62 in conduit 54.

Figure 4:
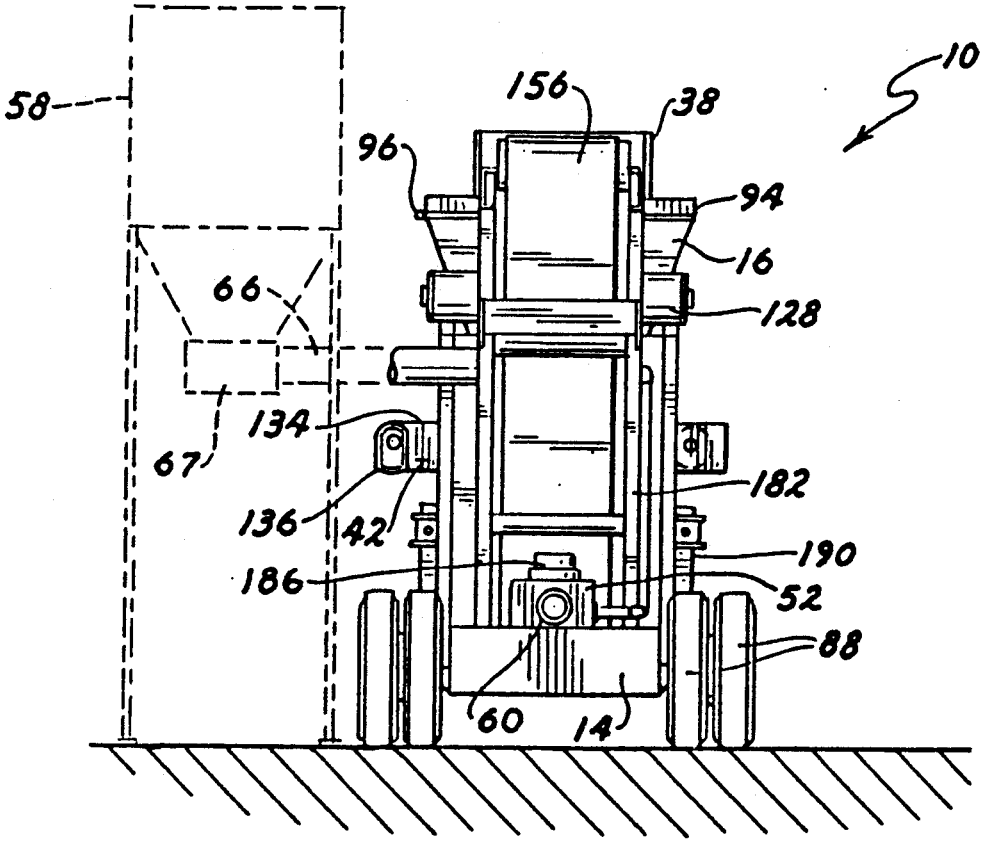
FIG. 4 is a rear view of a portable screening/dosing-/mixing plant in accordance with an embodiment of the invention.

In another embodiment, an aperture 64 is provided in the screen discharge chute 44 for accepting a screw conveyor 66 with motor 67. It is to be understood that the screw conveyor 66 may convey additive materials from any suitable container 58 as shown in FIG. 4. The additive container may be a ground-supported hopper, truck, trailer or other container.

If desired, a solid or liquid additive may alternatively be introduced earlier in the train 12, such as into hopper 16, onto primary conveyor 36, or onto the vibrating screen 40. If desired, other types of conveyors may be used for dosing the base material stream with additive. For most additives anticipated for use with this apparatus, the preferred place of introduction is within the screen discharge chute 44.

The entire process train 12 is configured so that it is supported on a trailer 14 to be pulled by a semi tractor, not shown, and it fits within a size envelope having a length 68 of no more than about 50.5 feet from kingpin 70 to rearmost wheel axle 72, width 74 no more than about 8 feet 5 inches, and height 76 no more than about 13.5 feet. In the illustrated embodiment, the trailer 14 is shown as having an overall length 78 from kingpin 70 to rearmost surface 80 of approximately 53 feet. With these dimensions, the plant 10 may be transported on highways in most states without needing escort vehicles. While the figures show the trailer 14 with a total of only four rear wheels 88, it is anticipated that additional wheels may be required in some instances to meet highway load requirements.

As depicted in the figures, the plant 10 is capable of processing up to 75-100 tons per hour, or more, of contaminated soil or other particulate material by adding to it a remediating material, intimately mixing the two streams, and discharging the mixture to a storage bin, vehicle, or other receiving area.

Primary hopper 16 is shown with straight sloping sides 82 and a truncated bottom 84 which opens onto the feeder conveyor or belt feeder 32. As depicted, the hopper 16 has a capacity of about 6 to 12 cubic yards (typically about 9 cubic yards), and is supported by frame 86.

The primary hopper 16 has an upper inlet 30 into which raw material such as contaminated soil is introduced by a conveyor, front end loader, or other machine, not shown. A grizzly 28 is mounted to the hopper inlet 30 for removing grossly oversized materials. As shown by comparing FIG. 1A with FIG. 2A, the grizzly 28 comprises a set of laterally spaced parallel bars 90 placed on edge and joined to form a bar screen. The grizzly 28 has an outside frame 94 which is pivotally attached along one side to the hopper side 82 with hinges 96. The grizzly 28 may be periodically pivotally raised by hydraulic cylinders 98 to permit oversize materials to slide off. A bar spacing 92 of about 4 inches will remove boulders, stumps, large tree branches and roots, etc. Only materials having a dimension smaller than the bar spacing 92 will pass into the hopper 16. If desired, the grizzly 28 may be mounted at an angle from the horizontal for continuous discharge of grossly oversize objects.

Figure 2:
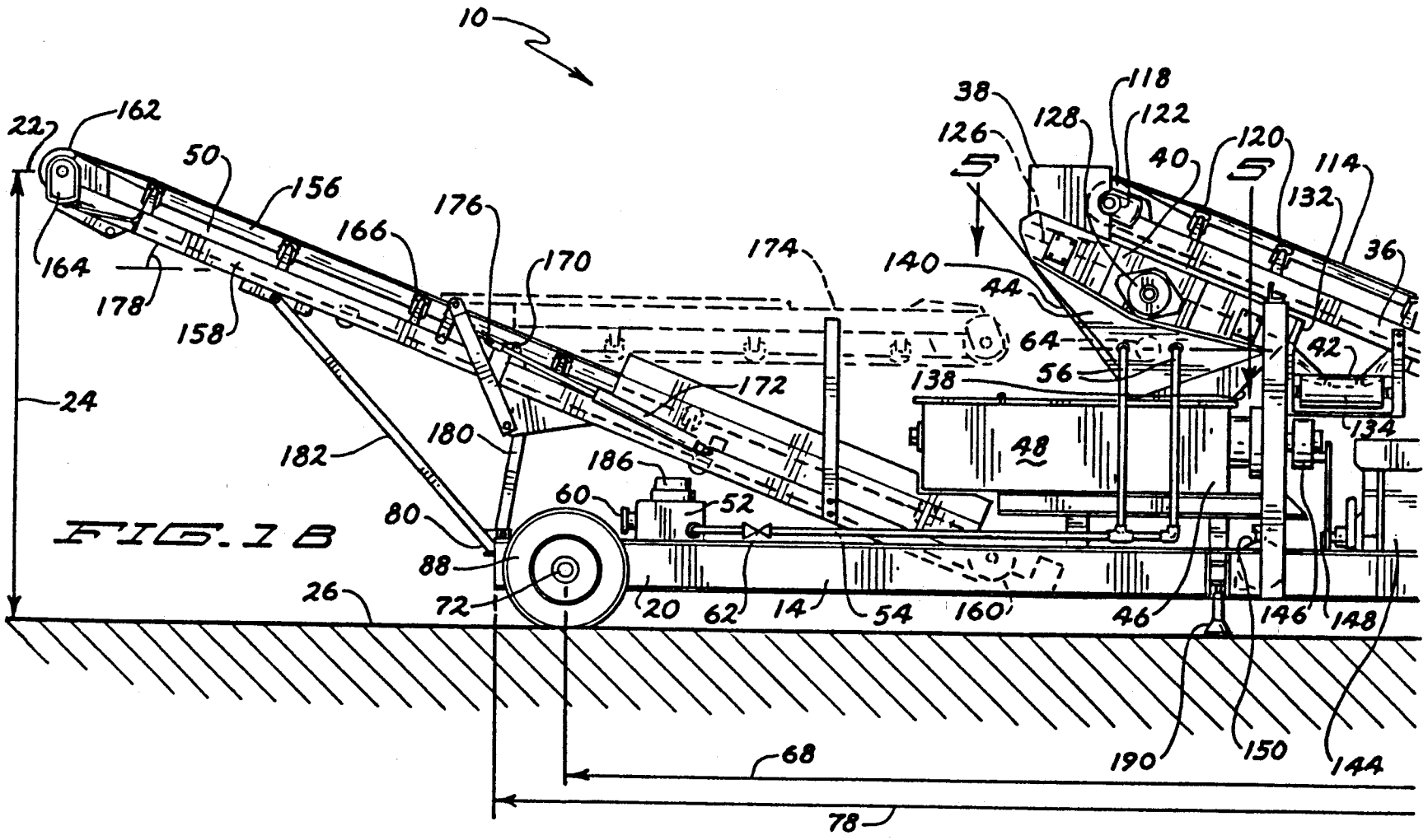
FIGS. 2A and 2B together form a top view of a portable screening/dosing/mixing plant in accordance with an embodiment of the invention.
Figure 2A:
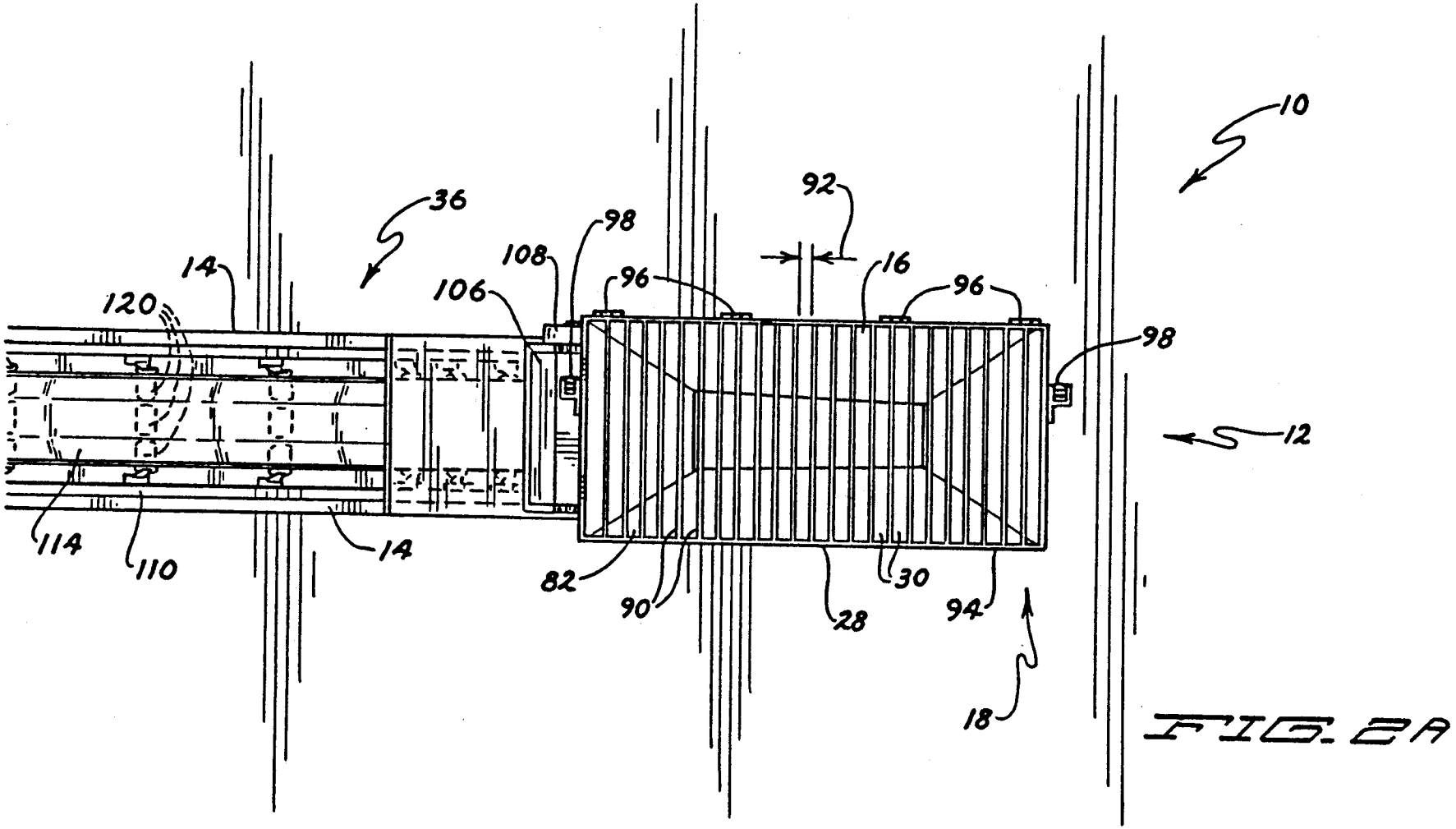
Figure 2B:
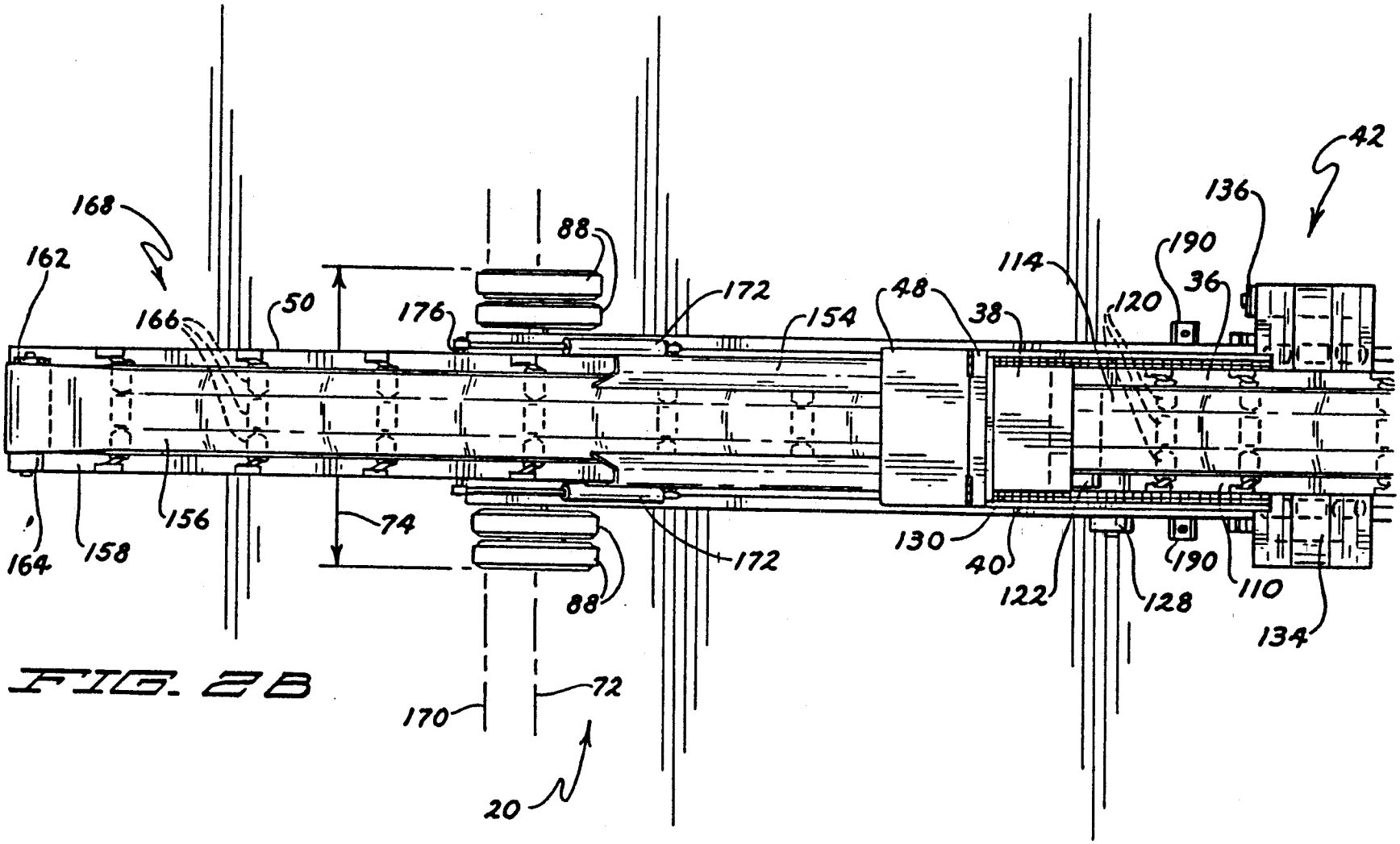

As shown in FIG. 1A. the belt feeder 32 is positioned below the hopper 16, and comprises an endless belting 100 with end pulleys 102 and closely spaced idler rollers 104. The belt feeder 32 is configured to provide a uniform discharge rate from the hopper 16 into shredder or pulverizer 34. The shredder 34 may be of the well-known hammermill type or other type of pulverizer for breaking up a continuous stream of material. FIGS. 1A and 2A depict the shredder 34 as a hammermill driven by a hydraulic motor 108. The shredder 34 must be capable of breaking up clods of hardened earth, earth containing solidified organic matter, and/or small pieces of plant matter. The shredded material is discharged from the shredder enclosure 106 to the primary belt conveyor 36.

As illustrated, primary belt conveyor 36 includes a framework 110, a receiving trough 112, endless belting 114 which encircles a tail end pulley 116 and a head, i.e., discharge end pulley 118. A series of spaced idler rollers 120 supports the belting 114 in a "deep trough" configuration for carrying high loads without spillage. The conveyor 36 is illustrated as being powered by a hydraulic motor 122 which turns the head end pulley 118. The figures depict the belting 114 as having a width of about 30–36 inches.

Conveyor 36 lifts the shredded materials to an elevation dictated by transport considerations. Generally, an elevation which provides a transport clearance of about 13.5 feet is considered appropriate. The conveyor 36 is configured to carry the materials upward at an angle 124 of about 18–22 degrees from the horizontal, the maximum angle generally attainable without backflow or overflow of materials from the belt 114.

The discharge hood 38 at the head end of the primary belt conveyor 36 comprises an enclosure for directing conveyed materials downward onto vibrating screen 40 which is immediately below. Such hoods are conveniently used for belt conveyors.

The vibrating screen 40 has a single downwardly sloped deck 126 and is vibrated by a hydraulic or electric motor 128. The screen medium 130 is preferably of between about $\frac{1}{2}\times\frac{1}{2}$ inch and $3\times3$ inch mesh for many applications. The screen mesh opening may be varied, depending upon the requirements of the particular application.

In the illustrated embodiment, the screen deck is 8 feet long by 4 feet wide.

In contrast to the screen mounting of other systems, the vibrating screen 40 is mounted in a reverse configuration so that oversize materials are moved toward the trailer front 18 rather than the rear, i.e. discharge end 20. In addition, the screen 40 is generally aligned with the belt conveyor 36, i.e. at an angle of about 18–22 degrees from the horizontal. As a result of this configuration, the materials passing through the screen 40 may be treated with an additive and be directly introduced into the mixer 48 without an intermediate conveyor or hopper, and without exceeding the 13.5 foot height limitation. In addition, the trailer space taken up by the screen 40, discharge chute 44 and mixer 48 is minimized, allowing room for a folding end conveyor 50 of 28 foot length or even greater.

A single deck vibrating screen useful in soil remediation is manufactured by Portec/Kolberg of Yankton, S. Dak., and may be powered by either an electrical motor or hydraulic drive.

The vibrating screen 40 has an oversize material discharge end 132 from which oversize materials are ejected onto cross-conveyor 42. The cross-conveyor 42 has a short belting 134 driven by motor 136. If desired, the cross-conveyor motor 136 may be reversible so that oversize material may be discharged from either side of the trailer.

Materials which pass through the screen medium 130 further pass in a stream downwardly through the discharge chute 44 which in turn feeds the pug mill mixer 48. The screen 40 is mounted at a height above the mixer 48 which permits the front chute wall 138 and rear chute wall 140 to have sufficiently vertical angles to shed the screened material.

For most applications, the preferred location in the train 12 for introducing i.e. dosing additives to the process material is within the discharge chute 44. Exemplary apparatus for accomplishing such introduction has been described above. The range of addition rates may vary widely, depending upon the particular process.

The mixer 48 is a pug mill of the type manufactured by various companies including Portec/Kolberg of Yankton, S. Dak. The mixer 48 is illustrated as a double shaft horizontal flow pugmill which is fed at the front end 46. The shafts 142 have attached paddles 152 (see FIG. 5) and are driven by a diesel engine 144 acting through a belt 148 and a speed reducer drive 146, as shown in FIG. 1. A fuel tank 150 is shown which supplies fuel to the engine 144.

The end conveyer 50 has a receiving trough 154 for receiving the mixed process materials and additive on the belting 156. The end conveyor 50 includes a frame 158, tail end pulley 160, head end pulley 162, head end drive motor 164, and spaced sets of idler rollers 166. The head end 168 of the conveyor folds over forwardly about axis 170 to the travel position 174 by the action of a pair of hydraulic cylinders 172 acting on pins 176.

The end conveyor 50 is supported at an angle 178 typically about 18–22 degrees from the horizontal, by central undercarriage members 180. When the head end 168 is folded upwardly and forwardly, undercarriage member 182 becomes disconnected at its lower end and lays against the conveyor 50.

The illustrated embodiment uses a fueled engine 144 such as an 80 hp diesel engine for driving the pug mill mixer 48. The engine 144 also drives a hydraulic pump 184 which supplies hydraulic motors driving the belt feeder 32, shredder 34, conveyors 36, 42 and 50, and vibrating screen 40. The hydraulic pump 184 also supplies high pressure fluid for the hydraulic cylinders 98 on the grizzly 28 and the cylinders 172 which fold the end conveyor 50. The additive pump 52 may also be driven by a hydraulic motor 186.

The conventional hydraulic system includes a fluid reservoir 188 as well as control valves and conduits directed to each hydraulic motor and cylinder. The fluid conduits and valves are not shown in the figures for the sake of clarity.

In the illustrated configuration, all equipment is driven by the on-board engine 144. No electrical hookups to external power sources are required.

Alternatively, some or all of the motor-driven equipment may have an electrical motor in place of the hydraulic motor. Operation of such a plant will require on-site electrical power. For the purposes of the invention, any type of motor may be used.

In most cases, the vibrating screen 40 is the factor which limits throughput of soil or other material through the plant 10. Thus, a 4 foot by 8 foot vibrating screen with a 2-inch opening mesh will permit a nominal soil remediation rate of about 100 tons per hour. However, the nominal capacity of a pug mill having an overall length of about 8 feet and a width of 4 feet is greater than 100 tons per hour, and may be up to 300 or more tons per hour, depending upon the materials being processed. This excess capacity results in greater material residence time in the pug mill, enhancing the degree of mixing.

Figure 3:
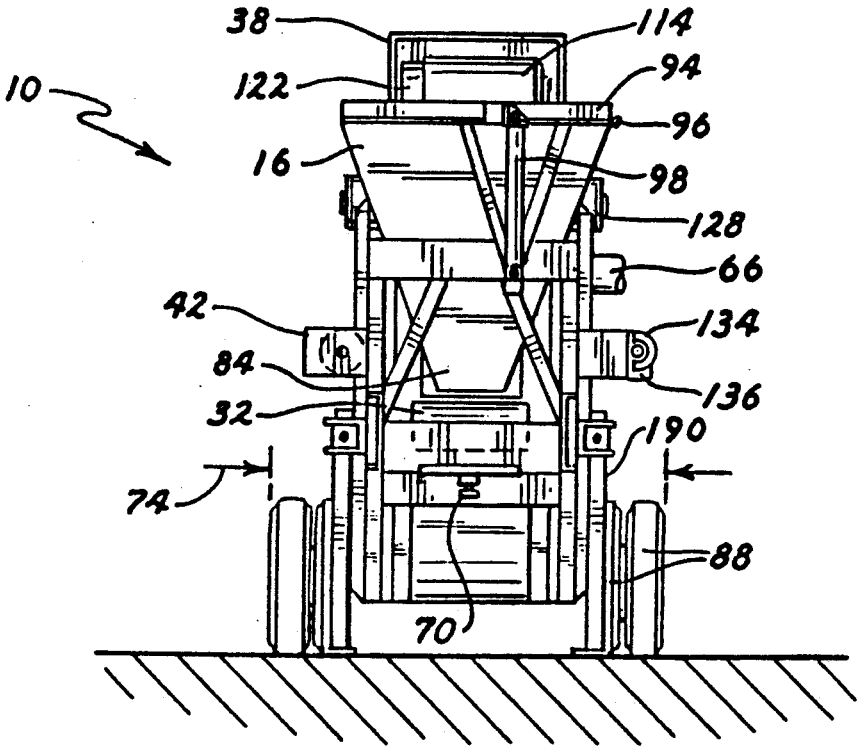
FIG. 3 is a front view of a portable screening/dosing-/mixing plant in accordance with an embodiment of the invention.

As indicated in FIGS. 1, 3 and 4, conventional jacks 190 are provided for stabilization of the trailer 14.

It is anticipated that various changes and modifications may be made in the construction, arrangement, operation and method of construction of the portable unitary screening/dosing/mixing plant disclosed herein without departing from the spirit and scope of the invention as defined in the following claims.

What is claimed is:

1. A portable unitary screening/dosing/mixing plant for treating particulate matter, comprising:

a transport trailer for over-the-road travel;

a screening/dosing/mixing train mounted on the trailer, said train comprising:

a coarse grizzly for receiving said particulate matter and removing oversize materials therefrom;

a hopper beneath said grizzly for receiving said grizzly-screened particulate matter through an upper inlet and discharging said grizzly-screened particulate matter through a lower outlet;

a generally horizontal conveyor belt feeder for receiving and transporting the grizzly passed particulate matter away from the hopper to a pulverizing shredder;

a pulverizing shredder for receiving grizzly passed particulate matter from the belt feeder, and continuously pulverizing and discharging said received particulate matter;

a primary belt conveyor for receiving and conveying said shredded particulate matter to a conveyor discharge hood;

a conveyor discharge hood for confining and directing said conveyed shredded particulate matter to a vibrating screen;

a vibrating single-deck screen mounted for receiving and screening said conveyed shredded particulate matter to remove oversize materials and discharge screened particulate matter, said screen mounted to move said screened particulate matter in a reverse direction;

a screen discharge chute for receiving said particulate matter passing through said screen, and for discharge thereof to a mixing means;

mixing means for receiving and continuously mixing screened particulate matter discharged from said screen discharge chute, and discharging the mixed particulate matter;

an end conveyor for receiving and conveying said discharged mixed particulate matter to an elevated location for end discharge into a transport vehicle, container, hopper or pile, said end conveyor having an inlet portion and a discharge portion, said discharge portion foldable over said inlet portion to a travel position; and means for introducing an additive material to the particulate matter upstream of said mixing means for intimate contact therewith.

2. The screening/dosing/mixing plant of claim 1, wherein said introducing means comprises means for pumping a liquid additive.

3. The screening/dosing/mixing plant of claim 1, wherein said introducing means comprises means for pumping a liquid additive at a controllable rate from a vessel into said screen discharge chute.

4. The screening/dosing/mixing plant of claim 1, wherein said introducing means comprises means for conveying a solid additive.

5. The screening/dosing/mixing plant of claim 1, wherein said introducing means comprises means for conveying a solid additive from a container into said screen discharge chute at a controlled rate.

6. The screening/dosing/mixing plant of claim 5, wherein said introducing means comprises an elongate screw conveyor.

7. The screening/dosing/mixing plant of claim 1, wherein said end conveyor is configured to discharge said mixed particulate matter and additive at an elevation of 8 to 15 feet above ground level.

8. The screening/dosing/mixing plant of claim 1, wherein said mixing means is a double shaft pugmill.

9. The screening/dosing/mixing plant of claim 1, wherein said plant is configured for the processing of at least 75 tons per hour of said particulate matter.

10. The screening/dosing/mixing plant of claim 1, wherein the overall length, width and height of said plant is configured for highway travel without escort vehicle(s).

11. The screening/dosing/mixing plant of claim 10, wherein the overall length from kingpin to rearmost end is no more than about 53 feet, the width is no more than about 8 feet 5 inches and height is no more than about 13.5 feet.

12. The screening/dosing/mixing plant of claim 1, wherein the vibrating screen is mounted beneath the head end of the primary conveyor in a reverse configuration and generally parallel to the primary conveyor.

13. A high rate portable unitary screening/dosing/mixing plant for soil remediation, comprising:

a transport trailer for over-the-road travel;

a screening/dosing/mixing train mounted on the trailer, said train comprising:

a coarse grizzly for receiving contaminated soils and removing oversize materials therefrom;

a hopper beneath said grizzly for receiving grizzly-screened contaminated soils, said hopper having an upper inlet and a lower outlet;

a generally horizontal belt conveyor feeder for transporting the grizzly-screened soils away from the hopper;

a shredder for receiving grizzly-screened soils from the belt conveyor feeder, and continuously pulverizing and discharging said received soils;

a primary belt conveyor for receiving and conveying said shredded soils to a conveyor discharge hood;

a conveyor discharge hood for confining and directing said conveyed shredded soils to a vibrating screen;

a vibrating single-deck screen mounted for receiving and screening said conveyed shredded soils to remove oversize materials and discharge secondary screened soils, said screen mounted in a reverse direction to move said secondary screened soils in a generally reverse direction;

a screen discharge chute for receiving said secondary screened soils from said screen, and for discharge thereof to mixer means;

mixing means for receiving and continuously mixing secondary screened soils discharged from said secondary hopper, and discharging the mixed soils;

an end conveyor for receiving and conveying said discharged mixed soils from the mixing means to an elevated location for end discharge into a transport vehicle, container, hopper or pile, said end conveyor having a tail end for receiving mixed soils and a head end for discharging said mixed soils at an elevated position distant from the trailer, said end conveyor upwardly foldable in a middle portion wherein said head end is folded over a tail end portion for transport of said trailer; and means for introducing an additive material to the soils upstream of said mixing means for intimate contact therewith.

14. The screening/dosing/mixing plant of claim 13, wherein said mixing means is a double shaft pugmill.

15. The screening/dosing/mixing plant of claim 13, wherein said plant is configured for the processing of at least 75 tons per hour of said soil.

16. The screening/dosing/mixing plant of claim 13, wherein the overall length, width and height of said plant is configured for highway travel without escort vehicle(s).

17. The screening/dosing/mixing plant of claim 16, wherein the overall length from kingpin to rearmost end is no more than about 53 feet, the width is no more than about 8 feet 5 inches and height is no more than about 13.5 feet.

18. The screening/dosing/mixing plant of claim 13, wherein the vibrating screen is mounted beneath the head end of the primary conveyor in a reverse configuration and generally parallel to the primary conveyor.

* * * * *